United States Patent [19]

Jennings

[11] Patent Number: 4,893,577

[45] Date of Patent: Jan. 16, 1990

[54] TOW ROPE PYLON WITH ROTATABLE BUSHING

[75] Inventor: Michael D. Jennings, Maryville, Tenn.

[73] Assignee: Mastercraft Boat Co., Maryville, Tenn.

[21] Appl. No.: 195,589

[22] Filed: May 18, 1988

[51] Int. Cl.[4] ..... B63B 21/04

[52] U.S. Cl. ..... 114/253; 440/34

[58] Field of Search ..... 114/242, 249, 251, 253, 114/254, 343, 361, 381; 441/75; 440/33, 34; 40/215; 273/360; 280/292, 480; 254/393, 389, 390, 413, DIG. 14

[56] References Cited

U.S. PATENT DOCUMENTS

| | | | |
|---|---|---|---|
| 237,262 | 2/1881 | Estep | 114/253 |
| 1,378,102 | 5/1921 | Froger | 114/253 |
| 2,793,740 | 5/1957 | Daudt | 254/393 |
| 3,285,572 | 11/1966 | Blackburn | 254/393 |
| 3,890,918 | 6/1975 | Sell | 114/253 |
| 4,561,375 | 12/1985 | Paxton | 114/253 |
| 4,587,921 | 5/1986 | Currey | 114/253 |
| 4,589,366 | 5/1986 | Eiber | 114/253 |
| 4,641,597 | 2/1987 | Paxton | 114/253 |
| 4,719,870 | 1/1988 | Whitley | 114/253 |

FOREIGN PATENT DOCUMENTS

| | | | |
|---|---|---|---|
| 1190288 | 4/1970 | United Kingdom | 114/253 |

OTHER PUBLICATIONS

Catalog page of Mastercraft Boat Co.

*Primary Examiner*—Joseph F. Peters, Jr.
*Assistant Examiner*—Clifford T. Bartz

[57] ABSTRACT

A pylon for a tow rope for water skiing and the like includes a bushing rotatably mounted on the upper end of the pylon for reducing friction between the tow rope and the pylon. The bushing includes a cylindrical central portion and radially enlarged upper and lower ends for maintaining the tow rope on the central portion. A rod on the upper end of the pylon extends through an opening in the bushing, and a cap is threadedly attached to the rod for retaining the bushing on the rod.

6 Claims, 1 Drawing Sheet

FIG. 1
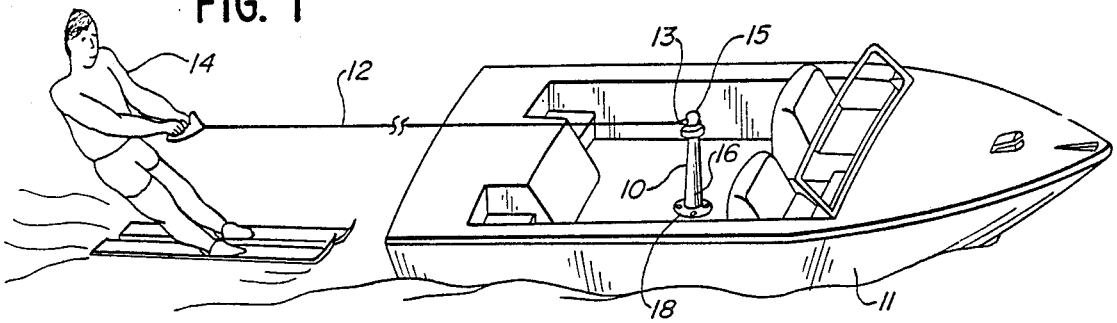
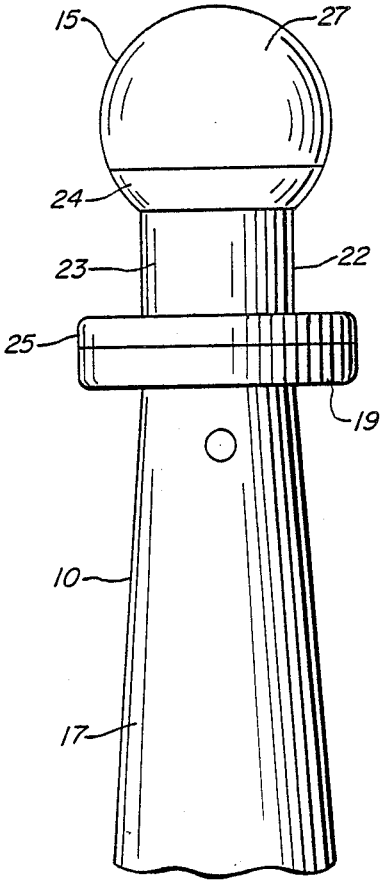
FIG. 2
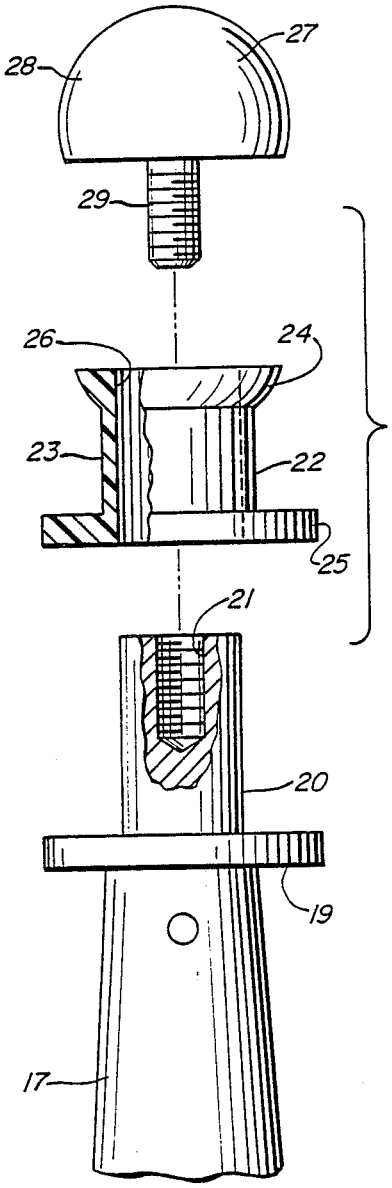
FIG. 3

TOW ROPE PYLON WITH ROTATABLE BUSHING

BACKGROUND

This invention relates to a pylon for a tow rope for waterskiing and the like. More particularly, the invention relates to a tow rope pylon with a rotatable bushing for reducing friction between the tow rope and the pylon.

Power boats which are used to pull water skiers are commonly equipped with a pylon which provides an anchor point for attaching the tow rope. The pylon is an elongated pole which is mounted in the center of the boat. The upper end of the pylon may include a radially enlarged flange and a spherical ball above the flange for retaining the tow rope on the pylon between the flange and the ball.

As a skier moves from one side of the wake to the other, the tow rope rotates about the pylon. Friction between the rope and the pylon can wear and abrade the rope and can interfere with the skier's movements. For example, in tournament slalom competition, the ski boat is steered along a path between two rows of buoys, and the competitor skis around buoys on alternate sides of the wake. After each pass, the tow rope is shortened. As the rope gets shorter, the skier moves faster from one side to the other, and the load on the pylon increases.

As the pulling force which is exerted by the tow rope on the pylon increases, friction reduces the freedom of the rope to pivot about the pylon. As a result, the rope sometimes "ratchets" about the pylon, i.e., the portion of the rope which engages the pylon will move in a series of discrete jerking movements rather than in one continuous smooth motion.

SUMMARY OF THE INVENTION

The invention reduces friction between the tow rope and the pylon by providing a rotatable bushing on the upper end of the pylon. The bushing permits the tow rope to rotate smoothly about the axis of the pylon even under heavy load conditions. The upper end of the pylon is provided with a transversely enlarged support flange and an axially extending cylindrical rod. A generally cylindrical bushing is rotatably supported by the flange and the rod, and a cap is threadedly attached to the rod for retaining the bushing on the rod. The bushing includes a cylindrical central portion and radially enlarged upper and lower ends for retaining the tow on the central portion. If desired, thrust washers can be inserted between the bushing and the flange and between the bushing and the cap to further reduce friction.

DESCRIPTION OF THE DRAWING

The invention will be explained in conjunction with an illustrative embodiment shown in the accompanying drawing, in which—

FIG. 1 illustrates a water ski boat equipped with a pylon formed in accordance with the invention;

FIG. 2 is a fragmentary elevational view of the pylon; and

FIG. 3 is an exploded fragmentary view, partially broken away, of the upper end of the pylon.

DESCRIPTION OF SPECIFIC EMBODIMENT

Referring to FIG. 1, a pylon 10 is attached to the floor of a power boat 11 on the keel line. A tow rope 12 has a looped end 13 which encircles the pylon, and a skier 14 is being pulled by the tow rope.

The pylon 10 includes upper and lower ends 15 and 16 and an elongated generally cylindrical tapered pole or base portion 17. An attaching flange 18 on the bottom of the pylon permits the pylon to be bolted to the boat with U-bolts or the like.

An annular support flange 19 extends radially outwardly from the top of the tapered pole portion, and a cylindrical rod portion 20 extends axially upwardly from the flange. The upper end of the rod is provided with an internally threaded hole 21.

A bushing 22 is rotatably mounted on the support flange 19 and the rod 20. The bushing includes a cylindrical central portion 23 and radially enlarged upper and lower ends 24 and 25. The enlarged lower end of the bushing provides an annular flange which has the same diameter as the support flange 19. The enlarged upper end of the bushing has the shape of a frustum of a sphere. The rod 20 extends through a central opening 26 in the bushing.

A cap 27 is attached to the rod 20 for retaining the bushing on the rod. The cap includes a spherical body 28 and a threaded stud 29 which is screwed into the hole 21 in the rod. The spherical surface of the enlarged upper end of the bushing 22 forms a continuation of the spherical surface of the cap 27. A thread adhesive may be applied to the threads of the stud 29 before the stud is screwed into the rod to provide a secure attachment.

The bushing 22 is advantageously formed from a self-lubricating polymeric bearing material such as nylon or high density polyethylene. In one specific embodiment, the pole portion of the pylon and the cap were made from 2000 series aluminum. The pole was turned on a lathe to form the taper, the flange 19, and the rod 20, and the rod was drilled and tapped to provide the threaded hole 21.

The looped end of the tow rope is slipped over the ball-shaped cap 27 onto the bushing 22. The enlarged ends of the bushing retain the rope on the cylindrical central portion of the bushing. As the skier moves from one side of the boat to the other, the rope and the bushing will rotate together around the rod 21. There is little or no relative movement between the rope and the bushing, and the rope will not be worn or abraded.

If desired, friction between the rotatable bushing 22 and the flange 19 and the cap 27 can be further reduced by annular thrust washers. Washers may be positioned above and below the bushing.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A pylon for a tow rope comprising:

a base having upper and lower ends for mounting the pylon on a support structure, a bushing rotatably mounted on the upper end of the base, the bushing having a tubular central portion and radially enlarged upper and lower ends for restraining movement of a tow rope off of the tubular central portion, said base including an elongated body portion, a transversely enlarged support flange adjacent the upper end of the base for supporting the bushing, and a rod portion which extends through the tubular central portion of the bushing.

2. The structure of claim 1 including a cap positioned above the upper end of the bushing and threadedly attached to the rod portion of the base for retaining the bushing on the base.

3. The structure of claim 2 in which the cap is generally spherical and the enlarged upper end of the bushing forms a continuation of the spherical shape of the cap.

4. A pylon for a tow rope comprising:

an elongated pole having a lower end adapted to be attached to a support structure and an upper end, the upper end of the pole having a transversely enlarged support flange and a cylindrical rod extending upwardly from the flange, a tubular bushing having a cylindrical opening, the bushing being rotatably supported by the support flange and the rod extending through the cylindrical opening in the bushing, and a cap above the bushing attached to the rod for retaining the bushing on the rod.

5. The structure of claim 4 in which the bushing includes a cylindrical central portion for holding a rope and radially enlarged upper and lower end portions for restraining movement of the rope off of the central portion.

6. The structure of claim 5 in which the bushing is made of polymeric material.

* * * * *